US009433985B2

(12) United States Patent
Clark et al.

(10) Patent No.: US 9,433,985 B2
(45) Date of Patent: Sep. 6, 2016

(54) FEED ROLL ASSEMBLY

(75) Inventors: Michael Trevor Clark, Sheffield (GB); Brian Cooper, Sheffield (GB); Stuart Leflay, Sothall (GB); Philip Round, Chesterfield (GB)

(73) Assignee: Siemens Plc., Camberley (GB)

( * ) Notice: Subject to any disclaimer, the term of this patent is extended or adjusted under 35 U.S.C. 154(b) by 389 days.

(21) Appl. No.: 14/111,810

(22) PCT Filed: Apr. 11, 2012

(86) PCT No.: PCT/EP2012/056590

§ 371 (c)(1),
(2), (4) Date: Jan. 3, 2014

(87) PCT Pub. No.: WO2012/140090

PCT Pub. Date: Oct. 18, 2012

(65) Prior Publication Data

US 2014/0033783 A1 Feb. 6, 2014

(30) Foreign Application Priority Data

Apr. 12, 2011 (GB) ..... 1106138.9
Sep. 2, 2011 (GB) ..... 1115196.6

(51) Int. Cl.
*B21B 39/16* (2006.01)
*B21B 1/32* (2006.01)

(52) U.S. Cl.
CPC . *B21B 39/16* (2013.01); *B21B 1/32* (2013.01)

(58) Field of Classification Search
CPC ..... B21B 1/32; B21B 31/20; B21B 39/14; B21B 39/16
See application file for complete search history.

(56) References Cited

U.S. PATENT DOCUMENTS

| | | | |
|---|---|---|---|
| 3,258,953 | A | 7/1966 | Hermes |
| 3,328,993 | A | 7/1967 | Roy et al. |
| 4,096,725 | A | 6/1978 | Kano |
| 4,538,706 | A | 9/1985 | Koppensteiner |

(Continued)

FOREIGN PATENT DOCUMENTS

| | | |
|---|---|---|
| CN | 200988055 Y | 12/2007 |
| DE | 945682 | 7/1956 |
| DE | 26 27 162 A1 | 12/1976 |

(Continued)

OTHER PUBLICATIONS

Machine Translation of Takashima et al., JP 2006289490A, date translated Jan. 8, 2016, pp. 1-5.*

*Primary Examiner* — Teresa M Ekiert
(74) *Attorney, Agent, or Firm* — Laurence A. Greenberg; Werner H. Stemer; Ralph E. Locher

(57) ABSTRACT

A feed roll and stripper assembly for a rolling mill includes at least one feed roll at each of an entry side and an exit side of a pair of work rolls and a stripper at each of the entry and exit side of the pair of work rolls. Each stripper has a stripper tip. At least one of the strippers or feed rolls are adapted to have an adjustable vertical separation from one of the work rolls, according to the direction of movement of material through the work rolls. The vertical separation of the at least one stripper or feed roll from the one work roll on the entry or exit side is different from the vertical separation of the other at least one stripper or the feed roll on the other of the entry or exit side. Each stripper tip is separated from one of the work rolls.

27 Claims, 4 Drawing Sheets

(56) References Cited

U.S. PATENT DOCUMENTS

| | | | |
|---|---|---|---|
| 5,195,347 | A | 3/1993 | Seto et al. |
| 8,365,566 | B2 | 2/2013 | Langer et al. |

FOREIGN PATENT DOCUMENTS

| | | | |
|---|---|---|---|
| DE | 3312009 | A1 | 10/1984 |
| DE | 285936 | A5 | 1/1991 |
| DE | 69108373 | T2 | 11/1995 |
| DE | 19946946 | A1 | 4/2001 |
| DE | 10 2007 048 747 | A1 | 3/2009 |
| GB | 1070551 | | 6/1967 |
| JP | S55139109 | A | 10/1980 |
| JP | 59177287 | S | 10/1984 |
| JP | S61283409 | A | 12/1986 |
| JP | 0433713 | H | 2/1992 |
| JP | 08155516 | A | 6/1996 |
| JP | 1157832 | H | 3/1999 |
| JP | 2003341990 | A | 12/2003 |
| JP | 2006239762 | A | 9/2006 |
| JP | 2006289490 | A | 10/2006 |
| JP | 2006326668 | A | 12/2006 |
| JP | 2007319879 | A | 12/2007 |
| JP | 4033713 | B2 | 1/2008 |
| SU | 11619 | A1 | 9/1929 |

* cited by examiner

PRIOR ART

PRIOR ART

FEED ROLL ASSEMBLY

BACKGROUND OF THE INVENTION

Field of the Invention

This invention relates to a feed roll and stripper assembly for a rolling mill and a method of setting up and operating the assembly.

In the field of metal rolling it is well known that the metal being rolled can stick to the surface of the roll and therefore a device known as a stripper is used to peel or strip the metal away from the surface of the roll and guide it out of the rolling mill.

One or more feed rollers can be used to guide and transport the material from the ingoing side of the mill into the work rolls and to guide and transport the material away from the work rolls on the outgoing side. Feed rollers are generally distinguished from the other roller tables around the mill area because they are installed between the housing posts of the mill stand in order to get them much closer to the work rolls than is otherwise possible. Getting the innermost feed rollers close to the work rolls is particularly important when rolling very short slabs or plates because if the distance is greater than approximately half the length of the slab or plate then there is a risk that the slab or plate will not feed properly. There may also be problems of excessive loading on the exit side and damage to the stripper if the set-up is not correct.

JP 8-155516 describes a method of preventing concave or convex warping after rolling caused by the amount of dog bone lifting the material above the roller table. This problem is addressed by changing the relative position of the pass line and feed rollers. In this document, a change in position of the stripper guide is achieved using an eccentric shaft drive, which changes the height of the stripper guide relative to the lower rolling roller and feed rollers, the stripper tip position being determined by where it contacts with the lower rolling roll.

BRIEF SUMMARY OF THE INVENTION

In accordance with a first aspect of the present invention a feed roll and stripper assembly for a rolling mill comprises at least one feed roll at each of an entry side and an exit side of a pair of work rolls; and a stripper at each of the entry and exit side of the pair of work rolls; wherein each stripper comprises a stripper tip; wherein at least one of the strippers and the feed rolls are adapted to have an adjustable vertical separation from one of the work rolls, according to the direction of movement of material through the work rolls; the vertical separation of the at least one of the strippers and the feed rolls from one of the work rolls on one of the entry and exit side being different from the vertical separation of the other of the at least one of the strippers and the feed rolls on the other of the entry and exit side; and wherein each stripper tip has a separation from the one of the work rolls.

The present invention controls the vertical separation of the stripper or feed rolls from the work roll, as well as the separation of the stripper tip from the work roll. This protects the material to be rolled by preventing contact between the work roll and the stripper tip, whilst benefiting from the ability to independently adjust the height of the stripper tip relative to the work roll at entry and exit sides.

Preferably, the vertical separation is measured from a first point on the work roll to a second point on the stripper or feed roll.

Preferably, the first point is a reference point at, or a fixed distance from, an uppermost point on the circumference of the work roll.

Preferably, the second point is a reference point at, or a fixed distance from, an uppermost point on the stripper or feed roll.

Preferably, the stripper or feed roll on an entry side of the pair of work rolls has a smaller vertical separation from the work roll than the stripper or feed roll on an exit side of the pair of work rolls.

Although the vertical separation may be established relative to the bottom of a top work roll, preferably the vertical separation is established relative to a bottom work roll of the pair of work rolls.

It is preferred that the vertical separation is measured from the closest point, i.e. the top of the bottom work roll, or the bottom of the top work roll, although it could be measured from any other repeatable point in the work roll.

Preferably, the stripper is mounted on a feed roll assembly.

Preferably, the feed roll assembly further comprises a slide attached to a feed roll support, wherein the feed roll assembly is adapted for movement on the slide.

Preferably, the feed roll support is a pivotable support.

Preferably, the pivotable support is adapted to move to position the feed roll and stripper at a vertical separation from the work roll.

Preferably, the pivotable support pivots on a base, at an end remote from the stripper and work roll.

Preferably, the support further comprises an actuator to move the support and feed roll.

Preferably, the rolling mill comprises a reversing mill.

As the mill reverses, the entry and exit sides change and the vertical separation of the strippers on each side is adapted according.

Preferably, the rolling mill comprises a single directional twin or tandem mill.

Preferably, each stripper is mounted on a work roll chock.

For a reversing mill, an adjustment mechanism is incorporated into the chocks such that the entry stripper can be made lower and the exit stripper higher every time the direction is reversed.

In accordance with a second aspect of the present invention a method of operating a feed roll assembly for a rolling mill, the assembly comprising at least one feed roll and a stripper and stripper tip on an entry side of a pair of work rolls and at least one feed roll and a stripper and stripper tip on an exit side of the pair of work rolls comprises determining according to the material to be rolled a required vertical separation of one of the entry and exit side strippers or feed rolls from one of the work rolls and setting the vertical separation of the entry side stripper or feed roll to be different from the vertical separation of the exit side stripper or feed roll; determining a minimum separation of the stripper tip from the work roll; and setting the stripper tip at a separation from the work roll greater than or equal to the minimum determined.

Preferably, the method further comprises passing an article to be rolled through the pair of work rolls in an initial direction from the entry side to the exit side; reversing the direction of operation and resetting the vertical separation of the entry and exit side stripper or feed roll for a new entry side and new exit side and passing the article back through the pair of work rolls.

Preferably, the method is repeated for a predetermined number of passes.

Preferably, the vertical separation at the new entry side is set to the same separation as at the old entry side and the vertical separation at the new exit side is set to the same separation as the old exit side.

The set up values for vertical separation may be used on each subsequent pass, or the values for vertical separation may be re-calculated for each pass, but preferably the vertical separation at the entry side is recalculated for each pass in the initial direction and applied at the entry side and new entry side.

Preferably, the method comprises setting the vertical separation of the entry side stripper or feed roll according to the anticipated draft.

Preferably, the method comprises setting the vertical separation of the entry side stripper or feed roll according to at least one of work roll diameter and pass line height.

Preferably, the vertical separation at the exit side is set to a position closer to the pass line height than the vertical separation at the entry side.

Preferably, the method comprises determining when a head end of an article being rolled has passed the stripper onto the feed roll assembly on the exit side and then causing an actuator to move the stripper further from the work roll than a required stripper gap.

The stripper on the exit side can be backed off from the work roll once the article is threaded, as there is no longer a risk of the article getting between the stripper and the work roll.

BRIEF DESCRIPTION OF THE SEVERAL VIEWS OF THE DRAWING

An example of a feed roll assembly for a rolling mill and a method of setting up and operating the assembly will now be described with reference to the accompanying drawings in which.

DESCRIPTION OF THE INVENTION

Figure 1A:
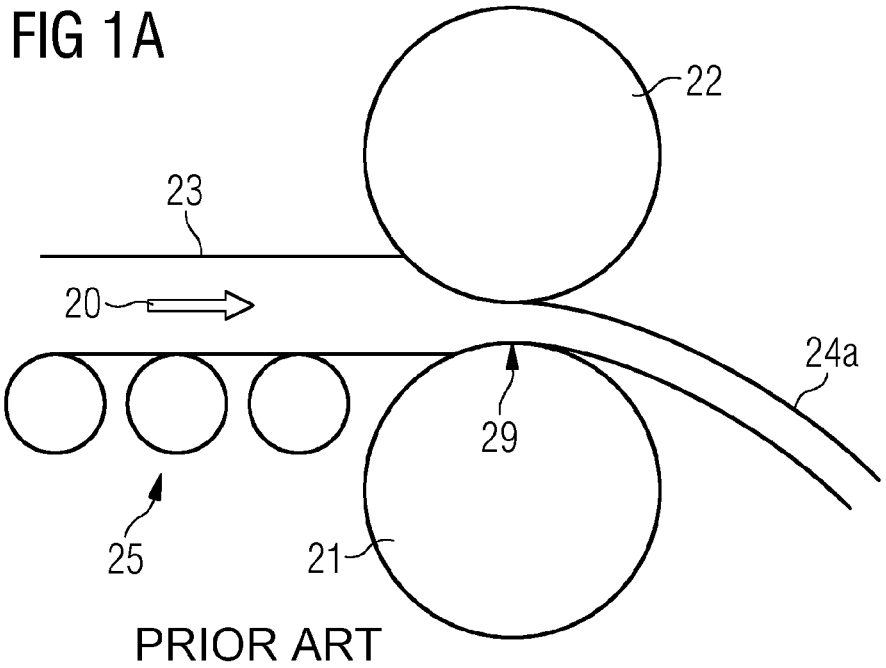
FIGS. 1A-1C illustrate how the position of the work roll relative to the entry feed roller influences turn up or turn down.

The vertical position of the bottom work roll relative to the entry feed roller height is very important for controlling turn up or turn down of the material being rolled. This is illustrated in FIG. 1. FIG. 1*a* shows a pair of work rolls 21, 22 and feed rollers 25. The work rolls 21, 22 receive material 23, transported on the feed rollers 25 in a direction of travel 20. The relative position of the feed rollers and the top 29 of the bottom work roll 21 is related to the required difference between the entry and exit thickness, known as the draft.

Figure 1B:
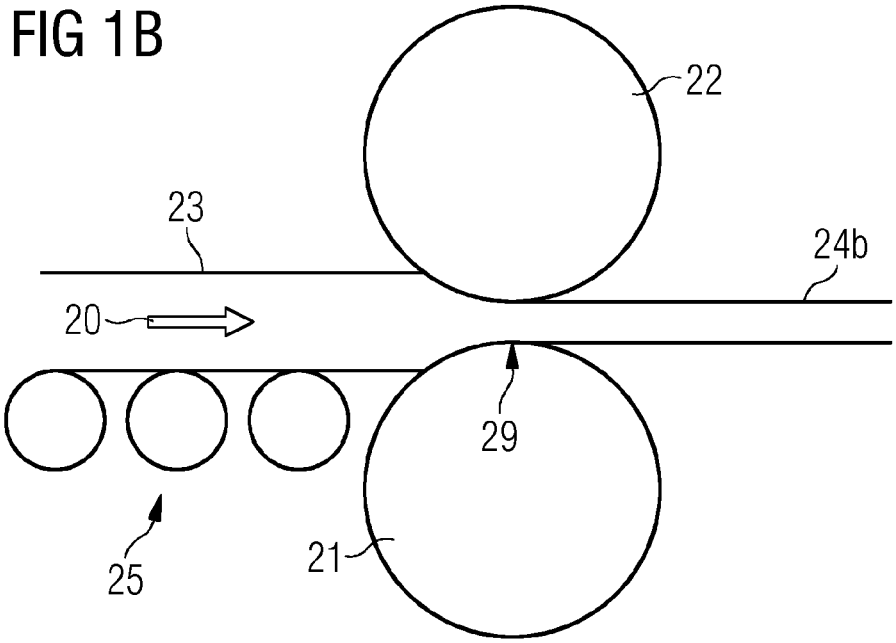
PRIOR ART FIG 1B
Figure 1C:
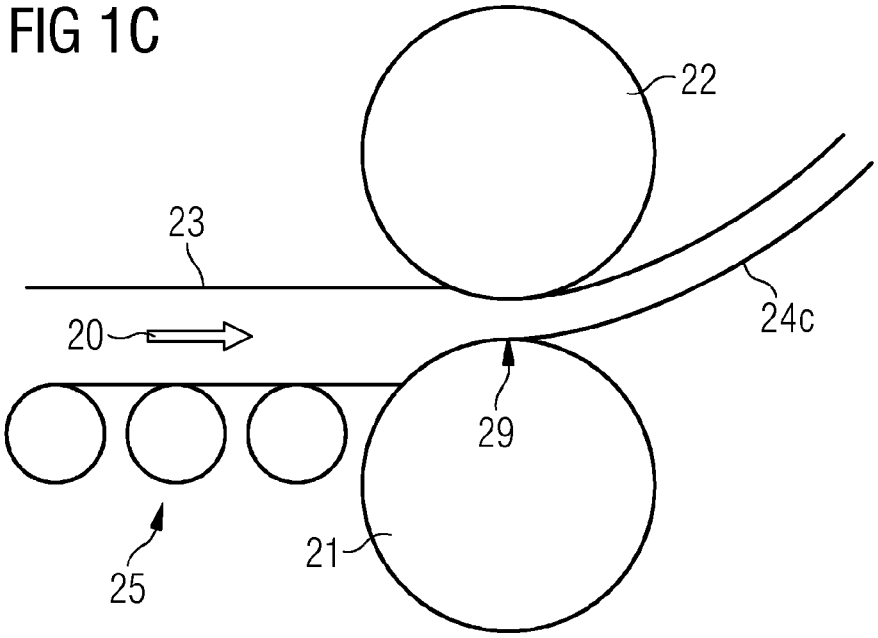

In the example of FIG. 1*a*, the feed rollers 25 are too high relative to the top 29 of the bottom work roll 21 for the draft that is being taken. Consequently the top part of the material 23 being rolled gets more reduction than the bottom part and this causes the material 24*a* to bend downwards at the exit from the work rolls 21, 22. For clarity, the exit stripper and feed rollers have been omitted from FIG. 1*a*, but in practice this turn down of the material 24*a* causes very high loads on the stripper and exit side feed rollers. Furthermore, bending of the material back upwards by the exit side feed rollers may easily cause undesirable distortion and damage to the material being rolled. In FIG. 1*b*, the entry side feed roller 25 is shown at the ideal height relative to the top 29 of the bottom work roll 21. Both the top part and the bottom part of the material 23 get equal reduction and the material 24*b* comes out of the work rolls straight. In FIG. 1*c*, the entry side feed rollers 25 are set too low relative to the top 29 of the bottom work roll 21 and the material 23 undergoes more reduction in the bottom part than in the top part and consequently the material 24*c* bends upwards on exit from the work rolls. The turn up of the material 24*c* causes problems with subsequent rolling, or processing and can cause damage to the equipment. In practice, the height of the entry feed rollers 25 is not the only factor affecting the turn up, or turn down, of the material and it is well known that temperature differences between the top part and the bottom part of the material, differences in diameter between the top and bottom rolls 21, 22, speed differences between the top and bottom rolls and other factors are involved, but the height of the entry feed rollers is none the less a very important factor.

Figure 2:
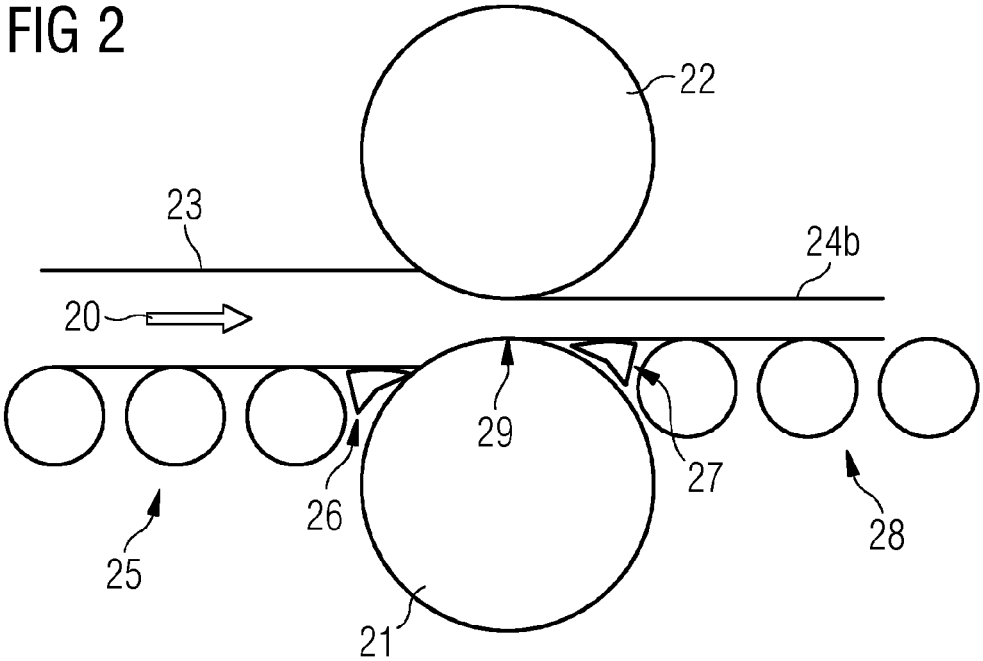
PRIOR ART FIG 2
FIG. 2 illustrates use of strippers in addition to relative position of the work rolls.

The ideal arrangement of strippers and feed rollers is to have the entry side feed rollers 25 positioned as illustrated in FIG. 1*b* and to have an exit side stripper 27 and feed rollers 28 positioned higher, so that the material 24*b* is stripped away from the roll 21 as early as possible and guided horizontally. This is illustrated in FIG. 2. In FIG. 2, the exit side stripper 27 is shown with a small gap between the tip of the stripper 27 and the work roll 21. In some types of mills, contact between the stripper and the work roll is acceptable, but in aluminium rolling, for example, it is important that the stripper does not contact the roll surface otherwise the stripper will damage the surface layer of the roll 21. The gap needs to be small enough to ensure that even the thinnest material that is rolled cannot force its way between the stripper and the roll and therefore precise alignment and positioning of the stripper 27 is required. FIG. 2 also shows an entry side stripper 26, but this obviously does not strip the material from the roll it simply helps to guide the material 23 into the roll bite.

A problem with the arrangement illustrated in FIG. 2 is that most rolling mills which roll plates and slabs are reversing mills, where a first reduction is taken with the material 23 passing through the work rolls in one direction 20 and then a second reduction is taken with the material passing through the work rolls in the opposite direction and so on, for as many reduction passes as is required. Many rolling mills have a method of adjusting the height of the bottom work roll 21 for the purposes of thickness control and consequently the bottom work roll is continuously moving up and down during rolling.

The arrangement illustrated in FIG. 2 is simple enough to achieve if the rolling mill is always rolling in the direction 20 illustrated, but if the mill reverses direction for the next pass, then the position of the feed rollers 28 and stripper 26 is completely wrong.

The most common method for mounting the strippers on plate mills is to fix them between the work roll chocks. An example is shown in U.S. Pat. No. 3,258,953. The positions of the strippers relative to the top of the work roll are usually preset when the rolls and chocks are assembled. Various means are used to set the position of the strippers relative to the top of the work roll including shims, bolts and eccentrics. But whatever the means used to adjust the stripper positions, they cannot be easily changed once the rolls are installed in the mill and therefore the entry and exit strippers are usually set both to the same height below the top of the work roll and this height has to be greater than half of the maximum draft that the mill will roll.

Another method of mounting the strippers is to attach them to either the entry and exit feed roller support frames, or to the mill housings, or to other equipment which is attached to the mill housings. Various methods of attaching the strippers directly or indirectly to the mill housing are used, the most common of which are pivoting connections, or sliding connections. DE3312009, DE19946946 and JP11057832 are examples of this type of stripper arrangement. DE2627162 is a similar type of stripper, except that the stripper itself incorporates a roll. JP4033713 describes a stripper arrangement which changes position after the material has passed between the strippers. None of these prior art designs can achieve the ideal positioning of the entry and exit side strippers and feed rollers as illustrated in FIG. 2 and also achieve the switching of the stripper and feed roll positions when the mill reverses direction.

DE102007048747 discloses a design in which the strippers are mounted on the feed roller assembly and this whole stripper and feed roll assembly can be moved horizontally. By linking horizontal movement of the feed roller assembly with vertical movement of the bottom work roll it is possible to set the height of the stripper and feed roller assemblies relative to the top of the bottom work roll. However since the movements of the stripper and feed roller assemblies are horizontal it is clear that the entry and exit side strippers and feed rollers have to be at the same height. Furthermore, due to the geometry it is clear that even a small vertical movement of the bottom work roll for the purpose of thickness control requires a much larger movement of the horizontal position of the feed roller assembly if the gap between the stripper and the roll is going to be maintained.

The present invention allows improved positioning of the strippers 26, 27 and feed rollers 25, 28 in a reversing rolling mill, such as hot mills, plate mills, or roughing mill stands, where turn up and turn down can be significant issues. The invention addresses the problem of controlling the distance between a point on a work roll closest to a surface of a material to be rolled and the height of feed rollers on which the material is transported, according to a required difference between entry and exit thickness of the material.

In the present invention, the entry and exit side strippers and feed rollers are made independently adjustable for height relative to the top of one of the work rolls. The strippers and feed rollers are rapidly adjustable, meaning that the strippers and feed rollers can be adjusted in the few seconds between reversing passes in the rolling mill to give the required gap between the stripper tip and the work roll, as well as the feed rollers being at the best height for the direction of movement. This can be used in single or twin reversing mills. Generally, the arrangement is adjusted relative to the top of the bottom work roll, although with some modifications, the same principle may be applied and adjustment made relative to the bottom of the top work roll. In this case, the arrangement is literally inverted, so that the strippers are next the top roll and are the other way up.

In addition, the present invention enables different stripper and feed roll heights to be set on a non-reversing mill, e.g. for aluminium cold mill stands, thereby optimising performance, even without being able to make any adjustment for successive passes, as is required in the reversing mill.

It can be seen from FIG. 2, that if the strippers are adjusted for height relative to the work roll, then in order to maintain a sufficiently small gap between the work roll and the stripper tip, the strippers have to move horizontally as well as vertically relative to the work roll.

In view of the fact that the mechanism must cater for different roll diameters and the requirement that the strippers also have to maintain the correct position when the roll moves vertically for thickness control purposes, it is convenient to achieve the correct positioning of each stripper by a combination of vertical movement and horizontal movement.

Figure 3:
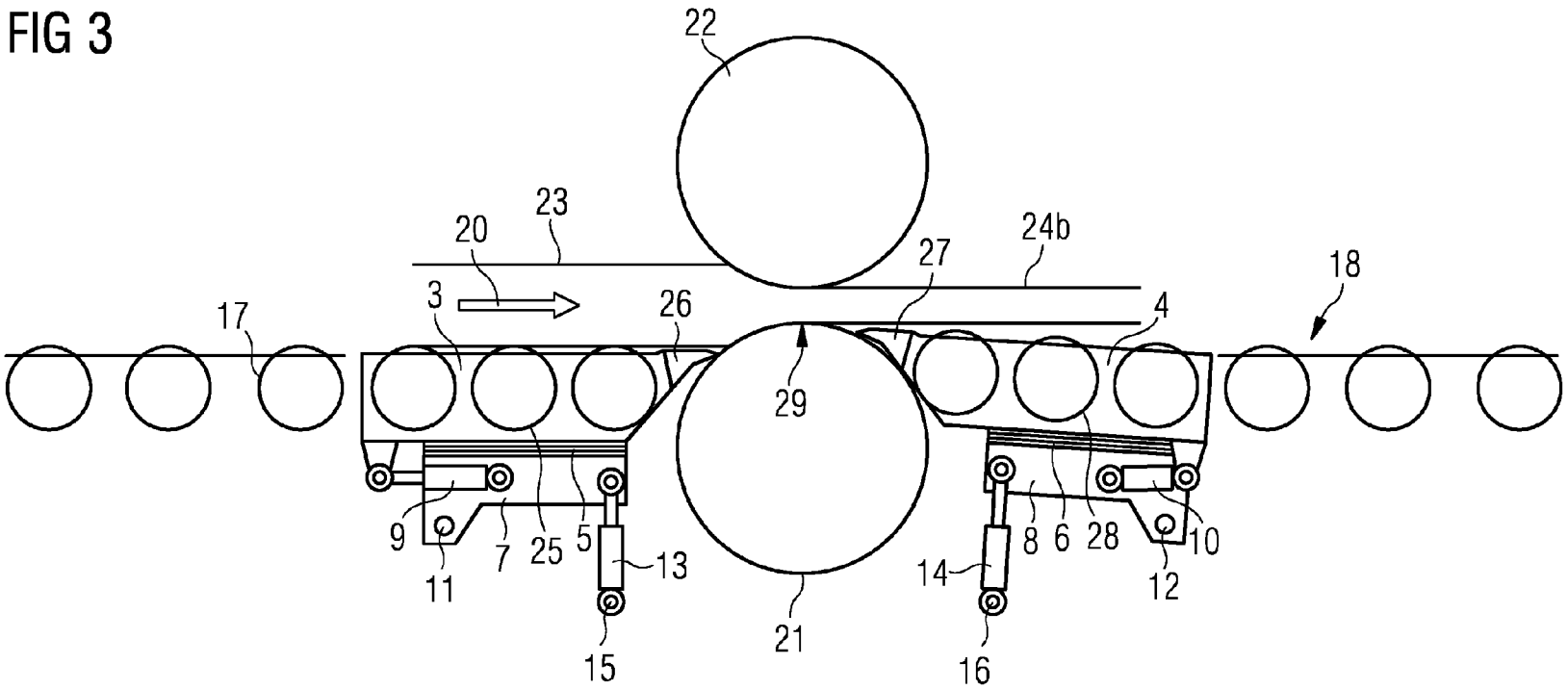
FIG. 3 illustrates a preferred embodiment of the present invention.

A preferred embodiment is illustrated in FIG. 3. In this embodiment, the strippers 25 and 27 are fixed to feed roller assemblies 3 and 4, supporting feed rollers 25, 28. The feed roller assemblies 3 and 4 are mounted on slides 5 and 6 so that the assemblies can move relative to feed roller supports 7 and 8. In this example, this movement is achieved by hydraulic cylinders 9 and 10, although other types of actuators can be used and the invention is not limited to this specific example. The hydraulic cylinders 9 and 10 in this example also contain external position transducers (although either internal or external transducers may be used) and the stroke of each of these cylinders may be independently position controlled by hydraulic servo-valves and controllers (not shown). The feed roller supports 7 and 8 are pivoted about pivots 11 and 12 which are fixed to the mill housing. The feed roller supports 7 and 8 can be moved about the pivots 11 and 12 by hydraulic cylinders 13 and 14. Clevises 15 and 16 of the hydraulic cylinders 13 and 14 are connected to pivots which are mounted on the mill housing. The hydraulic cylinders 13 and 14 also contain position transducers and the strokes of these cylinders are independently controlled by hydraulic servo-valves and controllers which are not shown.

From FIG. 3, it can be seen that a combination of movements between hydraulic cylinder 9 and hydraulic cylinder 13 can be used to position the stripper 26 at any desired height relative to the top of the work roll and to achieve any desired gap 42 between the work roll and the stripper tip 40. The movements of cylinder 9 and cylinder 13 may either be simultaneous and synchronised, so that the tip of the stripper follows an arc around the roll, or the movements may be sequential. In the case of sequential movements, the sequence depends upon whether the stripper is moving up or down. If the stripper 26 is moving up, it can move up using cylinder 13 first and then extend towards the roll 21 using cylinder 9. If the stripper is moving down, then it has to retract using cylinder 9 first and then lower using cylinder 13. Similarly, stripper 27 can be moved to any desired height relative to the top of the roll by using a combination of movements of cylinders 10 and 14.

When the work roll moves up or down for the purpose of thickness control, or pass-line adjustment, this movement may be followed by linking the movement of cylinders 13 and 14 with the vertical movement of the work roll. In the embodiment illustrated in FIG. 3, the strippers 26 and 27 do not move perfectly vertically when cylinders 13 and 14 move because of the effect of the pivots 11 and 12. The control system may control the stripper, either to stay at the same height relative to the top of the roll, but to change the stripper tip to work roll gap 42, 43, i.e. the gap between the stripper tip 40, 41 and the work roll surface, slightly, or to stay at the same gap and change the relative height slightly. In practice, the very small change in the height of the stripper below the top of the work roll, or the very small change in the roll gap, is not significant. It would be possible to make the whole feed roller and stripper assembly move vertically, but it is convenient to have the pivots 11 and 12 both for simplicity and to ensure that the feed rollers guide the material slightly up hill, or down hill to the level of the roller tables upstream 17 and downstream 18 of the mill, instead of there being a step in the height between the feed rollers and the other roller tables. Although possible, moving the whole of the upstream and downstream roller tables up and down, is not very practical or useful.

The embodiment illustrated in FIG. 3 uses hydraulic cylinders to achieve the movements, but clearly other actuators such as wedge systems, screw-jacks, eccentrics etc. may be used instead. The cylinders could be embedded in the feed roll table, with transducers either internal to or external to the cylinders and use servo or proportional valves. In an alternative embodiment, the required movement could also be achieved by, for example, allowing the strippers to move along a curved mechanical guiding arrangement which constrains the movement of the stripper to follow the circumference of the work roll. Other possibilities include a mechanical mechanism involving two or more links to approximate the arc of movement, or the use of eccentrics. An enhancement is to use load measurements and to calculate the deflection of the stripper and feed roller assembly due to the measured loads and to adjust the position of the strippers to compensate for this calculated deflection and thus reduce the chance of the stripper tips contacting the work roll. The load measurement could come either from pressure transducers connected to the hydraulic cylinders or from separate loadcells. Alternatively, the stripper gap may be measured directly.

An alternative embodiment is to move only the strippers 26, 27 independently and to keep the feed roller tables at the same height. Horizontal movement, whether under servo control or otherwise, allows for work roll turndown and roll changing, but in operation, it is not necessary to adjust the horizontal position of the feed roller tables between passes in the reversing mill.

Another alternative is to use strippers attached to the work roll chocks, as described in U.S. Pat. No. 3,258,953, which are therefore at the same height as each other and to move only the feed roller assemblies independently. These embodiments are better than the prior art described, but are not as close to the ideal as the embodiment illustrated in FIG. 3.

As illustrated by the positions in FIG. 3, in operation, before the material 23 enters the mill, the height of the entry feed rollers and stripper assembly is set according to the anticipated draft and other rolling parameters, including the roll diameter and pass-line height, whilst the exit stripper and feed roller assembly is normally set to a higher position, where it will strip the material 24*b* from the roll 21 and guide the material horizontally without allowing it to initially turn down. The entry and exit strippers may be set independently of one another. When the rolling in this direction finishes and the tail end of the material exits from the work rolls 21, 22, then the feed roller and stripper assemblies are rapidly moved to an almost mirror image position. This movement of the feed roller and stripper assemblies 3, 4, 26, 27 normally takes place simultaneously with the reversal of the material and the setup of the mill for the new entry thickness and exit thickness. At the new entry side, which was previously the exit side, the feed roller and stripper assembly 4, 27 is moved to a lower position, relative to the top 29 of the work roll, according to the anticipated draft for this pass and other parameters. At the new exit side which was previously the entry side the feed roller and stripper assembly 3, 26 takes up the high position to strip the material from the roll, as early as possible after the roll bite, to prevent the material from starting to turn down.

It is desirable that the exit stripper is in closest proximity to the work roll just as material is threaded into the roll bit. The hydraulic cylinder roll gap is set to a position which is intended to compensate for any mill stretch based upon the anticipated rolling load for that particular pass. However, in practice, the actual head end load tends to differ from this anticipated load to some extent. The roll load cylinder position may then be adjusted based upon a function of the difference between the actual and anticipated load and the mill stretch characteristic. This may act to either decrease or increase the stripper tip 40, 41 to work roll 21 gap 42, 43. As well as setting the stripper positions initially, the feed roller system can act dynamically to compensate for this change and help maintain the stripper gap at the desired value.

Whilst the preferred embodiment and the examples described have referred to the bottom roll it is also possible to do a similar thing on the top roll. Generally there are no driven feed rollers above the pass line, but as DE2627162 illustrates, the strippers and guides for the top roll can incorporate rollers. Thus, a similar system to that illustrated in FIG. 3 may be used for the strippers on the top roll simply by turning it upside down and replacing the feed roller assembly with a simple guide plate or similar.

In a typical system, the desired separation between a surface of the work roll closest to the material and the feed rollers is half the draft, plus 10 mm. A draft of 80 mm is typical, although it may be as much as 120 mm. For thinner materials, the feed roller table is relatively close to the work roll surface, whereas for thicker materials, there is a noticeable separation. For a reversing mill, there may be a need to change, between each pass, from 70 mm to 10 mm for the separation, or vice versa, according to the direction in which the material is moving through the work roll nip.

In the invention, entry and exit side strippers, or feed rolls, or a combination of both parts, e.g. with the strippers fixed to the frame of the feed roller assemblies may be independently set for height relative to the work roll and the height can be changed between rolling passes in a reversing rolling process. The gap between the stripper tip 40, 41 or feed roll 34, 35 and the surface of the work roll 21 on the exit side of the rolling direction may be set to a distance of less than the exit thickness of the material being rolled. Typically, the vertical separation on the exit side is smaller than on the entry side. The vertical position of the strippers or feed rolls may be linked to vertical movements of the work roll in order to maintain a constant relative height, or a constant gap between the stripper and the work roll. Movements along two different axes may be used to achieve the setting of the height and gap between the stripper tip and the work roll and the movements on the two different axes are done synchronously. If done sequentially this helps to avoid a clash between the stripper tip and the work roll. The parts on both entry and exit side are moveable independently and in such a way that they can be adjusted to a different vertical separation and also to achieve the desired stripper tip to roll gaps on the entry side and the exit side, with movement possible in both the vertical and horizontal directions to achieve both a different vertical separation and the correct roll gap, although when movement is of the feed rolls alone, this can be with just vertical or pivoting movement. The parts are moveable in a short time, of a few seconds, so that the vertical separations can be altered between passes in a reversing rolling process, which is not possible with manual adjustment systems. A preferred embodiment comprises strippers mounted on feed roller assemblies, feed roller assemblies sliding on feed roller supports, an actuator for the slide movement, feed roller supports pivoting about a pivot about a base, and an actuator to move the feed roller supports about the pivot.

The invention may also provide a method of rolling in a reversing rolling process where the height of the feed roller and stripper assembly at the entry side of each pass is set according to the anticipated draft and other rolling parameters including the roll diameter and pass-line height whilst the feed roller and stripper assembly at the exit side of each pass is set to a position closer to the pass-line height.

In view of the limits on space in the stripper area and concerns about damage to the roll when the tolerances are not correct, operation of the rolling mill may be further enhanced by positioning the stripper tip at the minimum gap only long enough for the head end of the material to pass through the work roll gap. Once the stripper is threaded and the head end has been safely passed through the roll gap, then the stripper tip is backed off out of the way. The back-off is carried out using standard assumptions about the shape and tolerances of the component parts of the assembly. After initial set-up, the movement away and movement back are kept the same, with the assumption that the resulting gap will be the same. Moving the stripper tip away from the work roll, other than for the initial threading of the article protects the work roll against adverse loading which occurs after the head end of the article being rolled has been safely threaded. The determination of the correct time to back-off the stripper tip may be based on tracking the article, detection of load on the mill stand, or stripper, tracking speed and time for the article to determine when the head end has passed through or some combination of these parameters. The gap is then actively opened sufficiently, once the head end has passed the stripping point, to give additional protection against roll contact in case of adverse loading.

The adjustment afforded by the feed roll assembly of the present invention also enables correction of the position of the feed roll table with respect to the work roll after a work roll change. As the work rolls become worn, they have to be removed and ground down to a smooth surface. When replaced, their size has changed, but this need not be an issue if the set-up includes positioning the feed rollers and strippers correctly for the new size roll, then for a reversing mill swapping the vertical settings in operation, according to which side is the entry or exit side, as described above.

Figure 4:
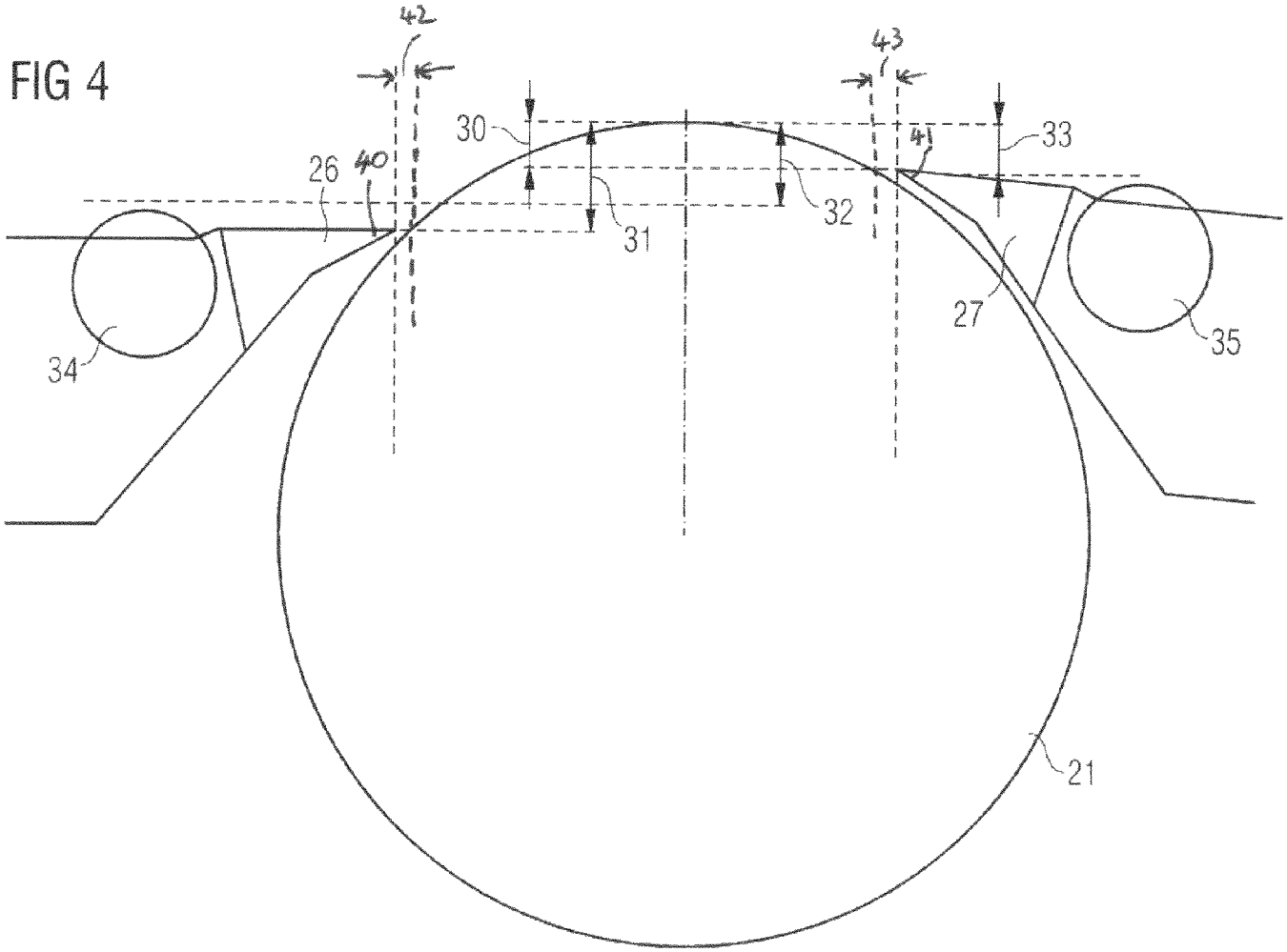
FIG. 4 illustrates examples of vertical separations in the present invention.

FIG. 4 illustrates an example of how the vertical separation is derived. In this example, the separation is measured with respect to the lower work roll 21 of the pair of work rolls. The separation may be measured, either from the top of the feed roll 34, 35 or the top of the stripper 26, 27. This gives a separation 31 on the entry side and a separation 30 on the exit side from the stripper. This gives a separation 32 on the entry side and a separation 33 on the exit side from the feed roll. It can be seen that although the actual point at which the measurement is made is offset, it is the vertical separation, or perpendicular distance between the two points which is determined. An alternative, not shown, is to use a reference point, a known, fixed distance from the top of the bottom work roll (or the bottom of the top work roll in another embodiment), or a reference point a known fixed distance from the top of the stripper or feed roll. It can be seen that there is also a separation 42, 43 of the stripper tip 40, 41 and the surface of the lower work roll 21.

The invention claimed is:

1. A feed roll and stripper assembly for a rolling mill, the assembly comprising:

a pair of work rolls defining an entry side and an exit side for a material to be rolled;

at least one feed roll at said entry side and at least one feed roll at said exit side; and a stripper at said entry side and a stripper at said exit side, each of said strippers having a respective stripper tip;

a feed roll assembly on which said strippers are mounted;

a feed roll support, said feed roll assembly being displaceably mounted on said feed roll support;

at least one of said strippers and said feed rolls configured to have an adjustable vertical separation from one of said work rolls, according to a direction of movement of the material through said work rolls;

said vertical separation of said at least one of said strippers and said feed rolls from said of said work rolls on one of said entry or exit side being different from said vertical separation of the other of said at least one of said strippers and said feed rolls on the other of said entry or exit side; and each of said stripper tips having a separation from said one of said work rolls.

2. The assembly according to claim 1, wherein said vertical separation is measured from a first point on said one of said work rolls to a second point on one of said strippers or feed rolls.

3. The assembly according to claim 2, wherein said one of said work rolls has a circumference, and said first point is a reference point disposed at, or a fixed distance from, an uppermost point on said circumference of said one of said work rolls.

4. The assembly according to claim 2, wherein said second point is a reference point disposed at, or a fixed distance from, an uppermost point on one of said strippers or feed rolls.

5. The assembly according to claim 1, wherein said stripper or feed roll on said entry side has a smaller vertical separation from said one of said work rolls than said stripper or feed roll on said exit side.

6. The assembly according to claim 1, wherein said vertical separation is established relative to a bottom work roll of said pair of work rolls.

7. The assembly according to claim 1, wherein the rolling mill is a reversing mill.

8. The assembly according to claim 1, wherein the rolling mill is a single directional twin or tandem mill.

9. A feed roll and stripper assembly for a rolling mill, the assembly comprising:

a pair of work rolls defining an entry side and an exit side for a material to be rolled;

at least one feed roll at said entry side and at least one feed roll at said exit side; and a stripper at said entry side and a stripper at said exit side, each of said strippers having a respective stripper tip;

a feed roll assembly on which said strippers are mounted, said feed roll assembly including a slide attached to a feed roll support, and said feed roll assembly being configured to move on said slide;

at least one of said strippers and said feed rolls configured to have an adjustable vertical separation from one of said work rolls, according to a direction of movement of the material through said work rolls;

said vertical separation of said at least one of said strippers and said feed rolls from said work rolls on one of said entry or exit side being different from said vertical separation of the other of said at least one of said strippers and said feed rolls on the other of said entry or exit side; and each of said stripper tips having a separation from said one of said work rolls.

10. The assembly according to claim 9, wherein said feed roll support is a pivotable support.

11. The assembly according to claim 10, wherein said pivotable support is configured to move for positioning one of said feed rolls and one of said strippers at a vertical separation from said one of said work rolls.

12. The assembly according to claim 10, wherein said pivotable support has an end remote from one of said strippers and said one of said work rolls, and said pivotable support pivots on a base at said end remote from said one of said strippers and said one of said work rolls.

13. The assembly according to claim 9, wherein said feed roll support includes an actuator configured to move said feed roll support and one of said feed rolls.

14. A method of operating a feed roll assembly for a rolling mill, the method comprising the following steps:

providing the assembly with a pair of work rolls defining an entry side and an exit side for a material to be rolled, at least one feed roll and a stripper with a stripper tip on the entry side, at least one feed roll and a stripper with a stripper tip on the exit side, and a feed roll assembly on which the strippers are mounted;

mounting the feed roll assembly displaceably on a feed roll support;

determining a required vertical separation of the stripper or at least one feed roll on the entry and exit side from one of the work rolls according to the material to be rolled;

setting the vertical separation of the stripper or the at least one feed roll on the entry side to be different from the vertical separation of the stripper or the at least one feed roll on the exit side;

determining a minimum separation of one of the stripper tips from one of the work rolls; and setting the one stripper tip at a separation from the one work roll being greater than or equal to the determined minimum separation.

15. The method according to claim 14, which further comprises:

passing the material to be rolled through the pair of work rolls in an initial direction from the entry side to the exit side;

reversing a direction of operation and resetting the vertical separation of the stripper or at least one feed roll on the entry and exit sides for a new entry side and a new exit side; and passing the article back through the pair of work rolls.

16. The method according to claim 15, which further comprises setting the vertical separation at the new entry side to the same separation as at the old entry side and setting the vertical separation at the new exit side to the same separation as the old exit side.

17. The method according to claim 15, which further comprises recalculating the vertical separation at the entry side for each pass in the initial direction and applying the recalculated separation at the entry side and the new entry side.

18. The method according to claim 14, which further comprises repeating the steps of the method for a predetermined number of passes.

19. The method according to claim 14, which further comprises setting the vertical separation of the stripper or the at least one feed roll on the entry side according to an anticipated draft.

20. The method according to claim 14, which further comprises setting the vertical separation of the stripper or the at least one feed roll on the entry side according to at least one of work roll diameter or pass line height.

21. The method according to claim 14, which further comprises setting the vertical separation at the exit side to a position closer to a pass line height than the vertical separation at the entry side.

22. The method according to claim 14, which further comprises determining when a leading end of a material being rolled has passed the stripper onto the feed roll assembly on the exit side and then causing an actuator to move the stripper further from the work roll than a required stripper gap.

23. The method according to claim 14, which further comprises measuring the vertical separation from a first point on one of the work rolls to a second point on one of the strippers or feed rolls.

24. The method according to claim 23, wherein the first point is a reference point disposed at, or a fixed distance from, an uppermost point on a circumference of one of the work rolls.

25. The method according to claim 23, wherein the second point is a reference point disposed at, or a fixed distance from, an uppermost point on one of the strippers or feed rolls.

26. The method according to claim 23, wherein the stripper or feed roll on the entry side has a smaller vertical separation from one of the work rolls than the stripper or feed roll on the exit side.

27. The method according to claim 23, which further comprises establishing the vertical separation relative to a bottom work roll of the pair of work rolls.

* * * * *